US012495910B2

(12) United States Patent
Rose et al.

(10) Patent No.: US 12,495,910 B2
(45) Date of Patent: Dec. 16, 2025

(54) HYBRID MATTRESS

(71) Applicant: Sleep Number Corporation, Minneapolis, MN (US)

(72) Inventors: Eric Rose, Piedmont, SC (US); Kody Lee Karschnik, Plymouth, MN (US); Chee Nong Yang, Princeton, MN (US)

(73) Assignee: Sleep Number Corporation, Minneapolis, MN (US)

( * ) Notice: Subject to any disclaimer, the term of this patent is extended or adjusted under 35 U.S.C. 154(b) by 570 days.

(21) Appl. No.: 17/743,857

(22) Filed: May 13, 2022

(65) Prior Publication Data

US 2022/0369827 A1 Nov. 24, 2022

Related U.S. Application Data

(60) Provisional application No. 63/191,086, filed on May 20, 2021.

(51) Int. Cl.

| | |
|---|---|
| ***A47C 27/00*** | (2006.01) |
| ***A47C 27/06*** | (2006.01) |
| ***A47C 27/08*** | (2006.01) |
| ***A47C 27/18*** | (2006.01) |

(52) U.S. Cl.

CPC ..... *A47C 27/088* (2013.01); *A47C 27/062* (2013.01); *A47C 27/081* (2013.01); *A47C 27/18* (2013.01)

(58) Field of Classification Search

CPC ..... A47C 27/00; A47C 27/088; A47C 27/062; A47C 27/081; A47C 27/10; A47C 27/18; A47C 27/15; A47C 27/064

See application file for complete search history.

(56) References Cited

U.S. PATENT DOCUMENTS

| | | | | |
|---|---|---|---|---|
| 1,371,362 A | | 3/1921 | Giese | |
| 1,393,755 A | | 10/1921 | Conlan | |
| 2,446,775 A | | 8/1948 | Marsack | |
| 3,082,438 A | | 3/1963 | Nachman, Jr. | |
| 3,166,768 A | | 1/1965 | Cunningham | |
| 4,389,743 A | * | 6/1983 | Callaway | A47C 27/066 5/722 |
| 4,435,864 A | * | 3/1984 | Callaway | A47C 23/047 5/709 |
| 4,449,261 A | * | 5/1984 | Magnusson | A47C 27/066 5/722 |
| 4,462,129 A | | 7/1984 | Brannock | |
| 4,644,597 A | | 2/1987 | Walker | |

(Continued)

FOREIGN PATENT DOCUMENTS

WO WO 2020/185308 9/2020

OTHER PUBLICATIONS

International Search Report and Written Opinion in International Appln. No. PCT/US2022/029191, mailed on Sep. 6, 2022, 16 pages.

(Continued)

*Primary Examiner* — Fredrick C Conley
(74) *Attorney, Agent, or Firm* — Fish & Richardson P.C.

(57) ABSTRACT

A mattress has a mattress top, a mattress bottom, and a mattress perimeter. The mattress included the following features. An air chamber has an air chamber perimeter. A coiled spring perimeter includes a first set of coiled springs surrounding the air chamber perimeter. A topper portion has a support layer between the air chamber and the mattress top.

18 Claims, 9 Drawing Sheets

(56) References Cited

U.S. PATENT DOCUMENTS

| | | | | |
|---|---|---|---|---|
| 4,766,628 | A | 8/1988 | Walker | |
| 4,788,729 | A | 12/1988 | Walker | |
| D300,194 | S | 3/1989 | Walker | |
| 4,829,616 | A | 5/1989 | Walker | |
| 4,890,344 | A | 1/1990 | Walker | |
| 4,897,890 | A | 2/1990 | Walker | |
| 4,908,895 | A | 3/1990 | Walker | |
| D313,973 | S | 1/1991 | Walker | |
| 4,991,244 | A | 2/1991 | Walker | |
| 5,105,488 | A | 4/1992 | Hutchinson et al. | |
| 5,144,706 | A | 9/1992 | Walker | |
| 5,170,522 | A | 12/1992 | Walker | |
| D368,475 | S | 4/1996 | Scott | |
| 5,509,154 | A | 4/1996 | Shafer et al. | |
| 5,537,699 | A * | 7/1996 | Bonaddio | A47C 27/063 5/717 |
| 5,564,140 | A | 10/1996 | Shoenhair et al. | |
| 5,642,546 | A | 7/1997 | Shoenhair | |
| 5,652,484 | A | 7/1997 | Shafer et al. | |
| 5,765,246 | A | 6/1998 | Shoenhair | |
| 5,903,941 | A | 5/1999 | Shafer et al. | |
| 5,904,172 | A | 5/1999 | Gifft et al. | |
| 6,037,723 | A | 3/2000 | Shafer et al. | |
| 6,108,844 | A | 8/2000 | Kraft et al. | |
| 6,161,231 | A | 12/2000 | Kraft et al. | |
| 6,202,239 | B1 | 3/2001 | Ward et al. | |
| 6,397,419 | B1 | 6/2002 | Mechache | |
| 6,483,264 | B1 | 11/2002 | Shafer et al. | |
| 6,686,711 | B2 | 2/2004 | Rose et al. | |
| 6,708,357 | B2 | 3/2004 | Gaboury et al. | |
| 6,763,541 | B2 | 7/2004 | Mahoney et al. | |
| 6,772,463 | B2 | 8/2004 | Gladney et al. | |
| 6,804,848 | B1 | 10/2004 | Rose | |
| 6,832,397 | B2 | 12/2004 | Gaboury et al. | |
| D502,929 | S | 3/2005 | Copeland et al. | |
| 6,883,191 | B2 | 4/2005 | Gaboury et al. | |
| 6,889,398 | B2 | 5/2005 | Lewis | |
| 7,389,554 | B1 | 6/2008 | Rose | |
| 7,865,988 | B2 | 1/2011 | Koughan et al. | |
| 8,336,369 | B2 | 12/2012 | Mahoney | |
| D691,118 | S | 10/2013 | Ingham et al. | |
| D697,874 | S | 1/2014 | Stusynski et al. | |
| D698,338 | S | 1/2014 | Ingham et al. | |
| D701,536 | S | 3/2014 | Shakal et al. | |
| 8,769,747 | B2 | 7/2014 | Mahoney et al. | |
| 8,893,339 | B2 | 11/2014 | Fleury et al. | |
| 8,931,329 | B2 | 1/2015 | Mahoney et al. | |
| 8,966,689 | B2 | 3/2015 | McGuire et al. | |
| 8,973,183 | B1 | 3/2015 | Palashewski et al. | |
| D728,254 | S | 5/2015 | Blazar et al. | |
| D737,250 | S | 8/2015 | Ingham et al. | |
| 9,314,118 | B2 | 4/2016 | Blazar et al. | |
| 9,578,941 | B2 | 2/2017 | MacLachlan et al. | |
| 9,730,524 | B2 | 8/2017 | Chen et al. | |
| 9,737,154 | B2 | 8/2017 | Mahoney et al. | |
| D809,843 | S | 2/2018 | Keeley et al. | |
| D812,393 | S | 3/2018 | Karschnik et al. | |
| 9,924,813 | B1 | 3/2018 | Basten et al. | |
| 10,143,312 | B2 | 12/2018 | Brosnan et al. | |
| 10,165,867 | B2 * | 1/2019 | Mossbeck | A47C 27/066 |
| D840,732 | S | 2/2019 | Peterson et al. | |
| 10,194,753 | B2 | 2/2019 | Fleury et al. | |
| 10,285,508 | B2 | 5/2019 | Rose et al. | |
| D857,433 | S | 8/2019 | Kiekhoefer et al. | |
| 10,531,745 | B2 | 1/2020 | McGuire et al. | |
| 10,539,170 | B2 | 1/2020 | Peterson et al. | |
| 10,575,654 | B2 | 3/2020 | Shakal | |
| 10,677,232 | B2 | 6/2020 | Shakal et al. | |
| 10,729,253 | B1 | 8/2020 | Gaunt | |
| 10,765,224 | B2 | 9/2020 | Chen et al. | |
| 10,813,470 | B2 | 10/2020 | Mahoney et al. | |
| 10,888,173 | B2 | 1/2021 | Shakal et al. | |
| 10,993,546 | B2 | 5/2021 | Shakal et al. | |
| 11,001,447 | B2 | 5/2021 | Shutes et al. | |
| 11,085,479 | B2 | 8/2021 | Griffith et al. | |
| 11,096,502 | B2 | 8/2021 | Rose et al. | |
| D932,808 | S | 10/2021 | Keeley | |
| 11,140,999 | B2 | 10/2021 | Peterson et al. | |
| 11,229,297 | B2 | 1/2022 | Gaunt | |
| 2002/0069462 | A1 | 6/2002 | Gaboury et al. | |
| 2004/0172767 | A1 | 9/2004 | Mossbeck et al. | |
| 2005/0204475 | A1 | 9/2005 | Schmitz et al. | |
| 2005/0235417 | A1 | 10/2005 | Koughan et al. | |
| 2008/0052830 | A1 | 3/2008 | Koughan et al. | |
| 2010/0043148 | A1 | 2/2010 | Rose et al. | |
| 2014/0250597 | A1 | 9/2014 | Chen et al. | |
| 2014/0373280 | A1 * | 12/2014 | Mossbeck | A47C 27/064 5/718 |
| 2015/0007393 | A1 | 1/2015 | Palashewski | |
| 2015/0026893 | A1 * | 1/2015 | Garrett | A47C 27/064 5/691 |
| 2015/0182418 | A1 | 7/2015 | Zaiss | |
| 2015/0196147 | A1 * | 7/2015 | Jensen | A47G 9/04 5/498 |
| 2016/0242562 | A1 * | 8/2016 | Karschnik | A47C 27/082 |
| 2018/0125259 | A1 | 5/2018 | Peterson et al. | |
| 2019/0082855 | A1 | 3/2019 | Brosnan et al. | |
| 2020/0187667 | A1 | 6/2020 | Shakal | |
| 2020/0323353 | A1 * | 10/2020 | Bergner | B68G 9/00 |
| 2020/0359805 | A1 | 11/2020 | Brosnan et al. | |
| 2020/0375369 | A1 | 12/2020 | Negus et al. | |
| 2020/0400135 | A1 | 12/2020 | Shakal et al. | |
| 2021/0145183 | A1 | 5/2021 | Negus et al. | |
| 2021/0145185 | A1 | 5/2021 | Negus et al. | |
| 2021/0177155 | A1 | 6/2021 | Stusynski et al. | |
| 2021/0244196 | A1 | 8/2021 | Mahoney et al. | |
| 2021/0251392 | A1 | 8/2021 | Shakal | |
| 2021/0330090 | A1 | 10/2021 | Shakal et al. | |
| 2021/0341006 | A1 | 11/2021 | Griffith et al. | |
| 2022/0192388 | A1 | 6/2022 | Smith et al. | |
| 2022/0218116 | A1 | 7/2022 | Rose et al. | |

OTHER PUBLICATIONS

International Preliminary Report on Patentability in International Appln. No. PCT/US2022/029191, mailed on Nov. 30, 2023, 9 pages.
U.S. Appl. No. 09/471,592, Shafer, filed Dec. 23, 1999.
U.S. Appl. No. 14/594,843, Rose et al., filed Jan. 12, 2015.
U.S. Appl. No. 17/410,424, Doffing et al., filed Aug. 24, 2021.
U.S. Appl. No. 17/495,296, Peterson et al., filed Oct. 6, 2021.
U.S. Appl. No. 17/582,253, Gaunt, filed Jan. 24, 2022.
U.S. Appl. No. 29/719,090, Kirk et al., filed Dec. 31. 2019.
U.S. Appl. No. 29/807,154, Negus, filed Sep. 9, 2021.
U.S. Appl. No. 29/821,785, Negus et al., filed Jan. 3, 2022.

* cited by examiner

HYBRID MATTRESS

CROSS-REFERENCE TO RELATED APPLICATIONS

This application claims the benefit of U.S. Provisional Application Ser. No. 63/191,086, filed May 20, 2021. The disclosure of the prior application is considered part of (and is incorporated by reference in) the disclosure of this application.

TECHNICAL FIELD

This disclosure relates to beds and mattresses.

BACKGROUND

In general, a bed is a piece of furniture used as a location to sleep or relax. Many modern beds include a soft mattress on a bed frame. The mattress may include springs, foam material, and/or an air chamber to support the weight of one or more occupants. The mattress may include a mattress cover.

SUMMARY

This specification describes technologies relating to hybrid mattresses, such as mattresses with coils in combination with other materials as shown and described herein.

An example embodiment of the subject matter described within this disclosure is a mattress with a mattress top, a mattress bottom, and a mattress perimeter. The mattress included the following features. An air chamber has an air chamber perimeter. A coiled spring perimeter includes a first set of coiled springs surrounding the air chamber perimeter. A topper portion has a support layer between the air chamber and the mattress top.

Aspects of the example embodiment, which can be combined with any of the example embodiments alone or in combination, include the following. The topper portion includes a layer of foam and a second set of coiled springs.

Aspects of the example embodiment, which can be combined with any of the example embodiments alone or in combination, include the following. The support layer include at least a first portion of the second set of coiled springs.

Aspects of the example embodiment, which can be combined with any of the example embodiments alone or in combination, include the following. A scrim is located between the layer of foam and the second plurality of springs.

Aspects of the example embodiment, which can be combined with any of the example embodiments alone or in combination, include the following. The second plurality of springs is below the layer of foam.

Aspects of the example embodiment, which can be combined with any of the example embodiments alone or in combination, include the following. The topper portion includes a topper portion perimeter including at least a second portion of the second set of coiled springs.

Aspects of the example embodiment, which can be combined with any of the example embodiments alone or in combination, include the following. The first portion of the second set of coiled springs and the second portion of the second set of coiled springs have different spring rates.

Aspects of the example embodiment, which can be combined with any of the example embodiments alone or in combination, include the following. The first set of coiled springs have a different spring rate than the second set of coiled springs.

Aspects of the example embodiment, which can be combined with any of the example embodiments alone or in combination, include the following. The topper portion is inset such that an upper surface of the topper portion is substantially in line with an upper surface of the coiled spring perimeter.

Aspects of the example embodiment, which can be combined with any of the example embodiments alone or in combination, include the following. A scrim is between the topper portion and the air chamber.

Aspects of the example embodiment, which can be combined with any of the example embodiments alone or in combination, include the following. The top of the coiled spring perimeter is connected to a bottom of the topper portion.

Aspects of the example embodiment, which can be combined with any of the example embodiments alone or in combination, include the following. A mattress cover encloses the topper portion, the coiled spring perimeter, and the air chamber.

Aspects of the example embodiment, which can be combined with any of the example embodiments alone or in combination, include the following. The coiled spring perimeter includes a pocketed coil system, wherein coiled springs of the first set of coiled springs are individually pocketed.

Aspects of the example embodiment, which can be combined with any of the example embodiments alone or in combination, include the following. The first set of coils includes an inner ring of coils positioned proximate the air chamber perimeter and an outer ring of coils positioned proximate the mattress perimeter.

Aspects of the example embodiment, which can be combined with any of the example embodiments alone or in combination, include the following. The air chamber includes a first air chamber positioned in the mattress for supporting a first user. The mattress further includes a second air chamber positioned in the mattress for supporting a second user. Both the first and second air chambers are positioned inside the coiled spring perimeter.

Aspects of the example embodiment, which can be combined with any of the example embodiments alone or in combination, include the following. The coiled spring perimeter and the topper portion combine to form an upside-down tub that covers the air chamber.

Aspects of the example embodiment, which can be combined with any of the example embodiments alone or in combination, include the following. The topper portion includes a first layer comprising a foam and a second layer including a second plurality of coiled springs positioned below the first layer. The second layer is positioned above both the air chamber and the coiled spring perimeter.

Aspects of the example embodiment, which can be combined with any of the example embodiments alone or in combination, include the following. The topper portion includes a first layer including a first foam and a second layer including a second foam different than the first foam. Both the first and second layers are positioned above both the air chamber and the coiled spring perimeter.

An example embodiment of the subject matter described within this disclosure is a system with the following features. A bed has a mattress including an air chamber with an air chamber perimeter. A coiled spring perimeter includes a first set of coiled springs surrounding the air chamber perimeter. A topper portion has a support layer between the air chamber and a top mattress of the mattress.

Aspects of the example embodiment, which can be combined with any of the example embodiments alone or in combination, include the following. A foundation is sized and configured to support the mattress.

An example embodiment of the subject matter described within this disclosure is a method with the following features. A mattress with a mattress top, a mattress bottom, and a mattress perimeter is formed. The mattress includes an air chamber with an air chamber perimeter. A coiled spring perimeter includes a first set of coiled springs surrounding the air chamber perimeter. A topper portion has a support layer between the air chamber and the mattress top.

Aspects of the example embodiment, which can be combined with any of the example embodiments alone or in combination, include the following. The topper portion includes a foam layer and a second set of coiled springs.

Aspects of the example embodiment, which can be combined with any of the example embodiments alone or in combination, include the following. The support layer includes at least a first portion of the second set of coiled springs.

Aspects of the example embodiment, which can be combined with any of the example embodiments alone or in combination, include the following. The topper portion includes a topper portion perimeter comprising at least a second portion of the second set of coiled springs.

Aspects of the example embodiment, which can be combined with any of the example embodiments alone or in combination, include the following. The first portion of the second set of coiled springs and the second portion of the second set of coiled springs have different spring rates.

Aspects of the example embodiment, which can be combined with any of the example embodiments alone or in combination, include the following. Forming the mattress includes positioning the topper portion inside an interior space defined by the coiled spring perimeter. The topper portion has a geometry such that an upper surface of the topper portion is substantially in line with an upper surface of the coiled spring perimeter.

Aspects of the example embodiment, which can be combined with any of the example embodiments alone or in combination, include the following. Forming the mattress further includes receiving a scrim between the topper portion and the air chamber.

Aspects of the example embodiment, which can be combined with any of the example embodiments alone or in combination, include the following. The mattress is received by an adjustable foundation. The mattress is retained to the adjustable foundation platforms of the adjustable foundation so as to retain the air chamber, coiled spring perimeter, and topper portion on the adjustable foundation.

Aspects of the example embodiment, which can be combined with any of the example embodiments alone or in combination, include the following. The coiled spring perimeter is compressed to a compressed state and the coiled spring perimeter is stored in the compressed state prior to forming the mattress.

Aspects of the example embodiment, which can be combined with any of the example embodiments alone or in combination, include the following. The mattress is compressed to a compressed state that compresses the coiled spring perimeter and storing the mattress in the compressed state after forming the mattress.

An example embodiment of the subject matter described within this disclosure is a mattress with a mattress top, a mattress bottom, and a mattress perimeter. The mattress includes the following features. A mattress core has a core perimeter. A coiled spring perimeter includes a first set of coiled springs surrounding the core perimeter. A topper portion is positioned above the mattress core.

Aspects of the example embodiment, which can be combined with any of the example embodiments alone or in combination, include the following. The mattress core includes no coiled springs.

Aspects of the example embodiment, which can be combined with any of the example embodiments alone or in combination, include the following. A cover encloses the mattress core, the coiled spring perimeter, and the topper.

Particular embodiments of the subject matter described in this specification can be implemented so as to realize one or more of the following advantages. The mattresses described herein can facilitate quality and efficient mattress construction. For example, a mattress with a coiled spring perimeter as described herein can provide support around the edge of the mattress with springs while using one or more other materials such as foam and/or one or more air chambers at other locations of the mattress. The mattresses described herein can allow additional air-flow, for both static and dynamic air flow options, through the mattress when compared to other mattresses. The increased air flow allows for improved breathability and removal of built-up heat.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to a mattress using coiled springs in combination with other mattress materials. The mattress can include a mattress core with a perimeter around the mattress core. The mattress core can include one or more air chambers. A set of coiled springs surrounds the mattress core perimeter to form a coiled spring perimeter. Atop the mattress core is one or more mattress layers integrated with the mattress. The mattress layers can include one or more layers of foam and/or one or more layers of coiled springs. The coiled spring perimeter and the mattress topper can be attached to one another to form an upside-down, or inverted, tub that encompasses the mattress core.

Figure 1:
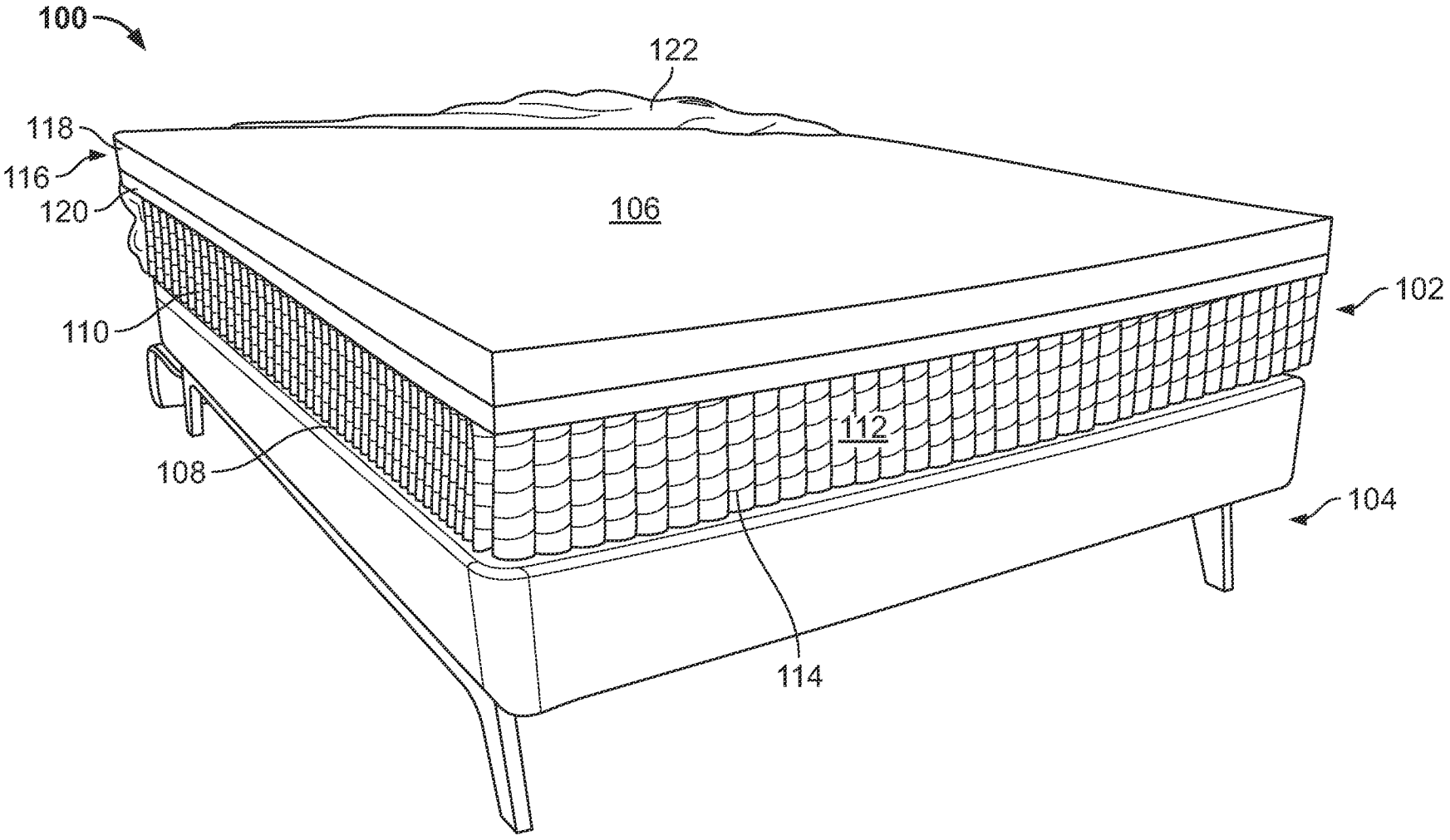
FIG. 1 is a perspective view of an example mattress resting atop a foundation.

FIG. 1 is a perspective view of an example bed 100 that includes a mattress 102 resting atop a foundation 104 (such as an adjustable foundation having adjustable foundation platforms or a non-adjustable foundation). The mattress 102 has a mattress top 106, a mattress bottom 108, and a mattress perimeter 110. The mattress 102 includes a coiled spring perimeter 112 made up of coiled springs 114. A topper portion 116 rests atop the coiled spring perimeter 112 and a mattress core (not shown in FIG. 1). The topper portion 116 can include one or more layers of open cell foam, closed cell foam, coiled springs, or other suitable material for supporting one or more uses at the mattress top 106.

In one example, the topper portion 116 can include a first layer 118 and a second layer 120. The first layer 118 can include a first foam and the second layer 120 can include a second foam different than the first foam. Regardless of composition, both the first layer 118 and second layer 120 are positioned above the mattress core and the coiled spring perimeter 112. While illustrated as having a two layer topper portion 116, the mattress 102 can include more or fewer support layers without departing from this disclosure. Alternatively or in addition, the layers of the topper portion 116 can include other materials, such as one or more layers or zones of ticking, spacer material, air chambers, down, down alternative, or springs without departing from this disclosure. A cover 122 can enclose the internal components of the mattress 102, such as enclosing the topper portion 116, the coiled springs 114, and the core. The cover 112 is pulled aside in FIG. 1 to show the internal components of the mattress 102.

Figure 2:
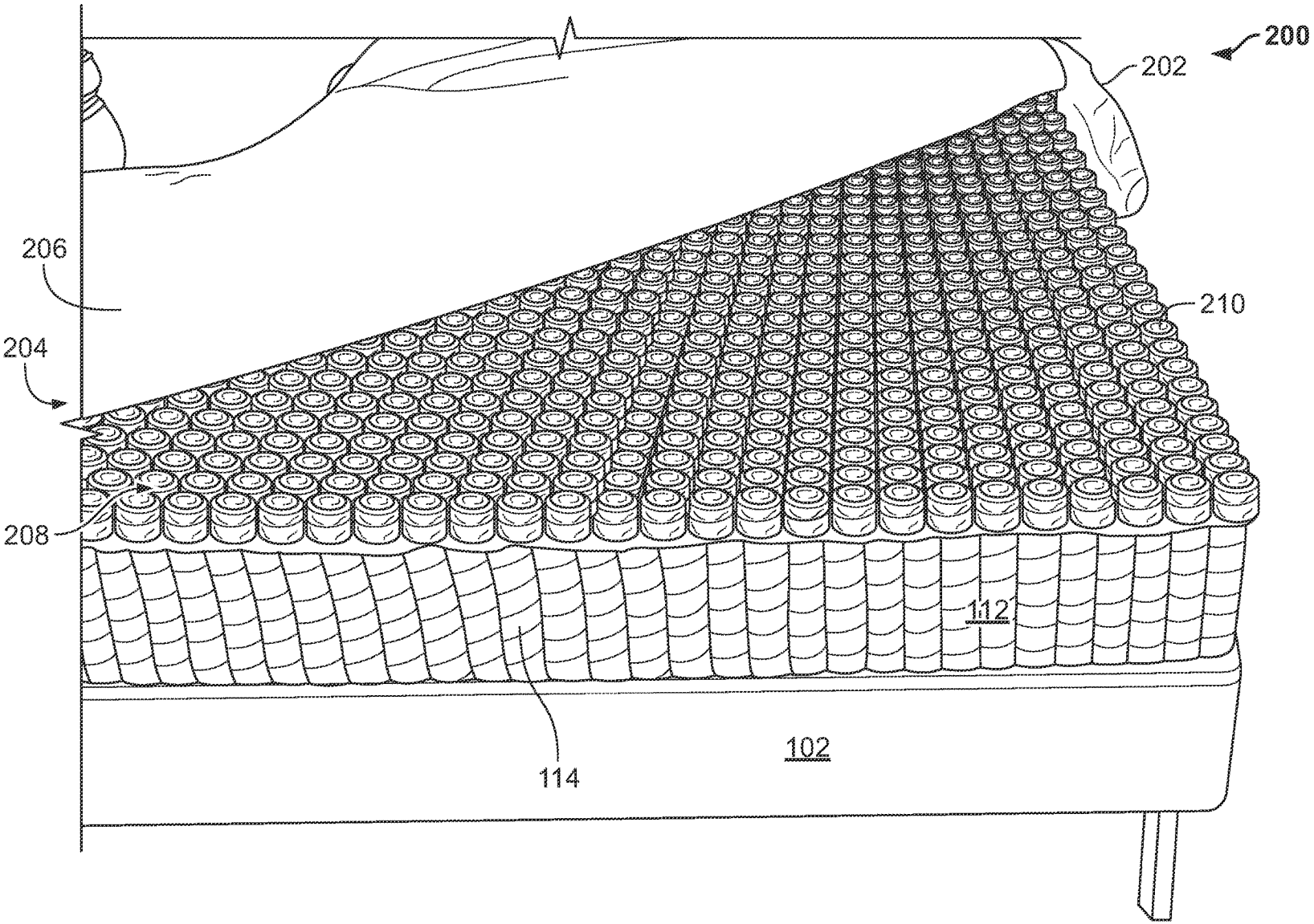
FIG. 2 is a perspective view of an example mattress resting atop a foundation with a cover removed.

FIG. 2 is a perspective view of an example mattress 200 resting atop the foundation 104 with a cover 202 removed. The mattress 200 is substantially similar to the mattress 102 previously described with the exception of any differences described herein. In some embodiments, the cover 202 of the mattress 200 encloses the topper portion 204, the coiled spring perimeter 112, and the mattress core (not shown in FIG. 2). In some embodiments, the topper portion 204 can include a first layer 206 with foam (such as a viscoelastic foam or other foam suitable for the application) and a second layer 208 with a second set of coiled springs 210 positioned below the first layer 206. The second layer 208 is positioned above both the mattress core and the coiled spring 112. The second set of coiled springs 210 can have a substantially different geometry than the springs 114 in the coiled spring perimeter 112. For example, a spring 210 within the topper portion 204 can have a different spring parameters, (such as spring diameter, spring wire diameter, spring index, spring free length, spring solid height, spring pitch, spring stiffness, Wahl stress factor, and/or spring rate) than a spring 114 within the coiled spring perimeter 112. In some embodiments, the springs 114 in the coiled spring perimeter 112 can be relatively firm as comparted the springs 210 in the second layer 208 of the topper portion 204 such that the springs 114 provide a relatively stiff and firm mattress perimeter and the springs 210 provide a relatively soft yet supportive mattress top for supporting one or more users sleeping or otherwise resting on the mattress 200.

Figure 3:
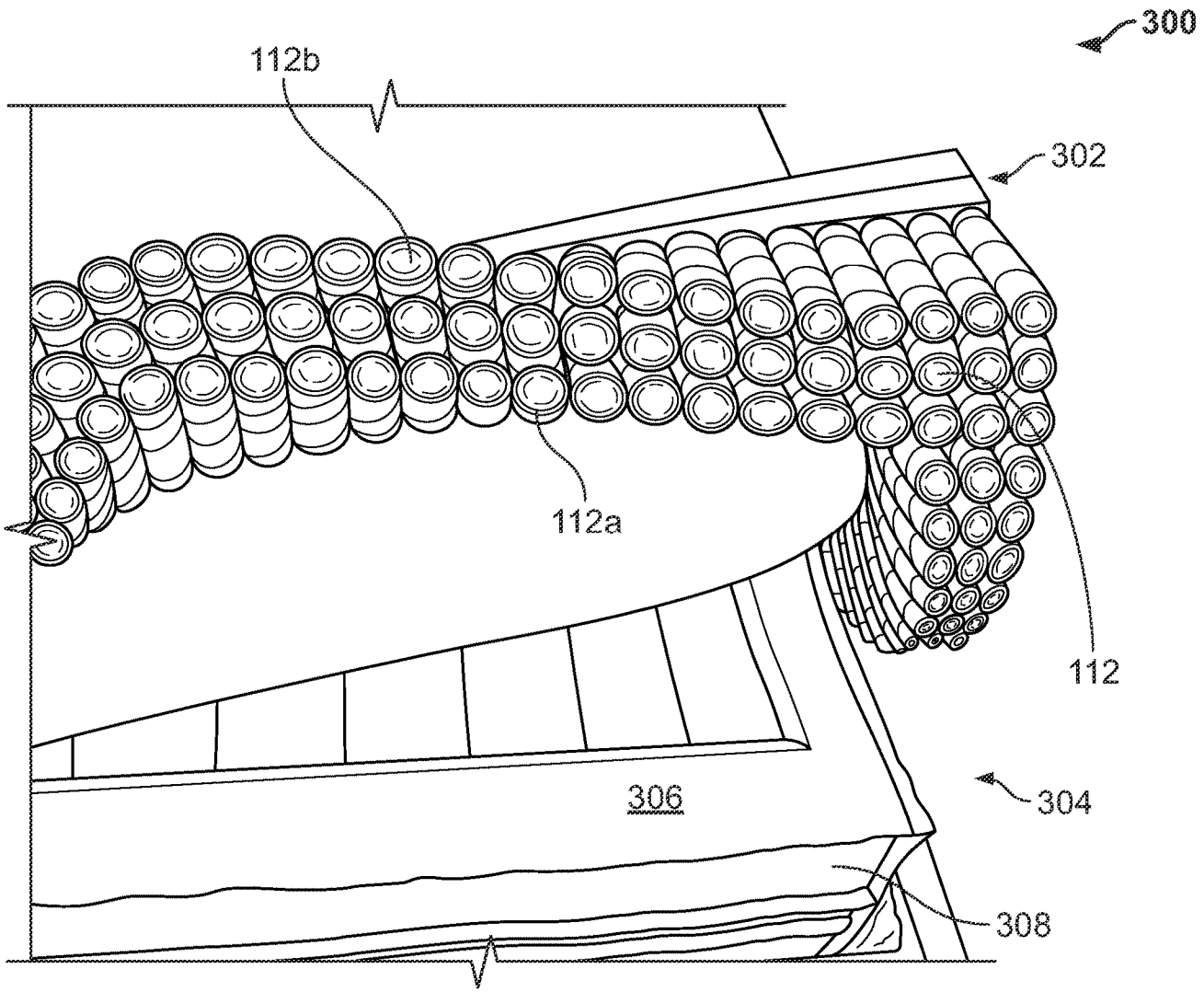
FIG. 3 is a perspective view of an example mattress with a coiled spring perimeter and topper pulled away from a mattress core.

FIG. 3 is a perspective view of an example mattress 300 with a coiled spring perimeter 112 and topper portion 302 pulled away from a mattress core 304. The mattress 300 is substantially similar to the mattress 102 previously described with the exception of any differences described herein.

The mattress core 304 can include one or more air chambers 306 having an air chamber perimeter 308. The spring perimeter 112 surrounds the air chamber perimeter 308 of the one or more air chambers 306. The air chambers 306 can be inflatable air chambers that are fluidically connected to one or more pumps or blowers controlled by one or more controllers (not shown in FIG. 3) for inflating and deflating the air chambers 306. For example, the air chambers 306 can include a left air chamber for supporting a first user on a left side of the mattress 300 and a right air chamber for supporting a user on a right side of the mattress 300. The air chambers 306 can be selectively inflated to provide variable firmness to the first and second users. In combination, the mattress core 304 and the topper portion 302 can provide both comfort and support for the users on the mattress 300.

In some embodiments, other mattress cores can be used without departing from this disclosure. For example, in one embodiment the mattress core 304 can be formed of one or more foam members without any inflatable air chambers. In such an embodiment, the mattress core 304 can be positioned within the spring perimeter 112 and under the topper portion 302 to provide support for one or more users resting on the mattress 300. In other embodiments, the mattress core 304 can include a combination of one or more foam members and one or more air chambers. In still other embodiments, the mattress core 304 can include other mattress components, for example, such as one or more of a water-filled core portion, a foam core portion, a spring core portion, an air chamber core portion, and/or other core portions suitable for the application.

In some embodiments, a top of the coiled spring perimeter 112 can be connected to a bottom of the topper portion 302 to form an inverted (or upside-down) tub that covers the mattress core 304. In some embodiments, the coiled spring perimeter 112 includes a pocketed coil system. The springs can be individually pocketed or pocketed in groups by being sewn or glued in one or more layers of fabric. The coiled spring perimeter 112 can include one, two, or more rings of coiled springs. For example, as shown in FIG. 3, the coiled spring perimeter 112 can include an inner ring of coils 112*a* positioned proximate the air chamber perimeter 308 and an outer ring of coils 112*b* positioned proximate the mattress perimeter. As illustrated, the coiled spring perimeter 112 includes three columns of coils between the mattress perimeter and the air chamber perimeter 308, but greater or fewer columns of springs can be used. For example, one column of springs or five columns of springs can be used.

Figure 4:
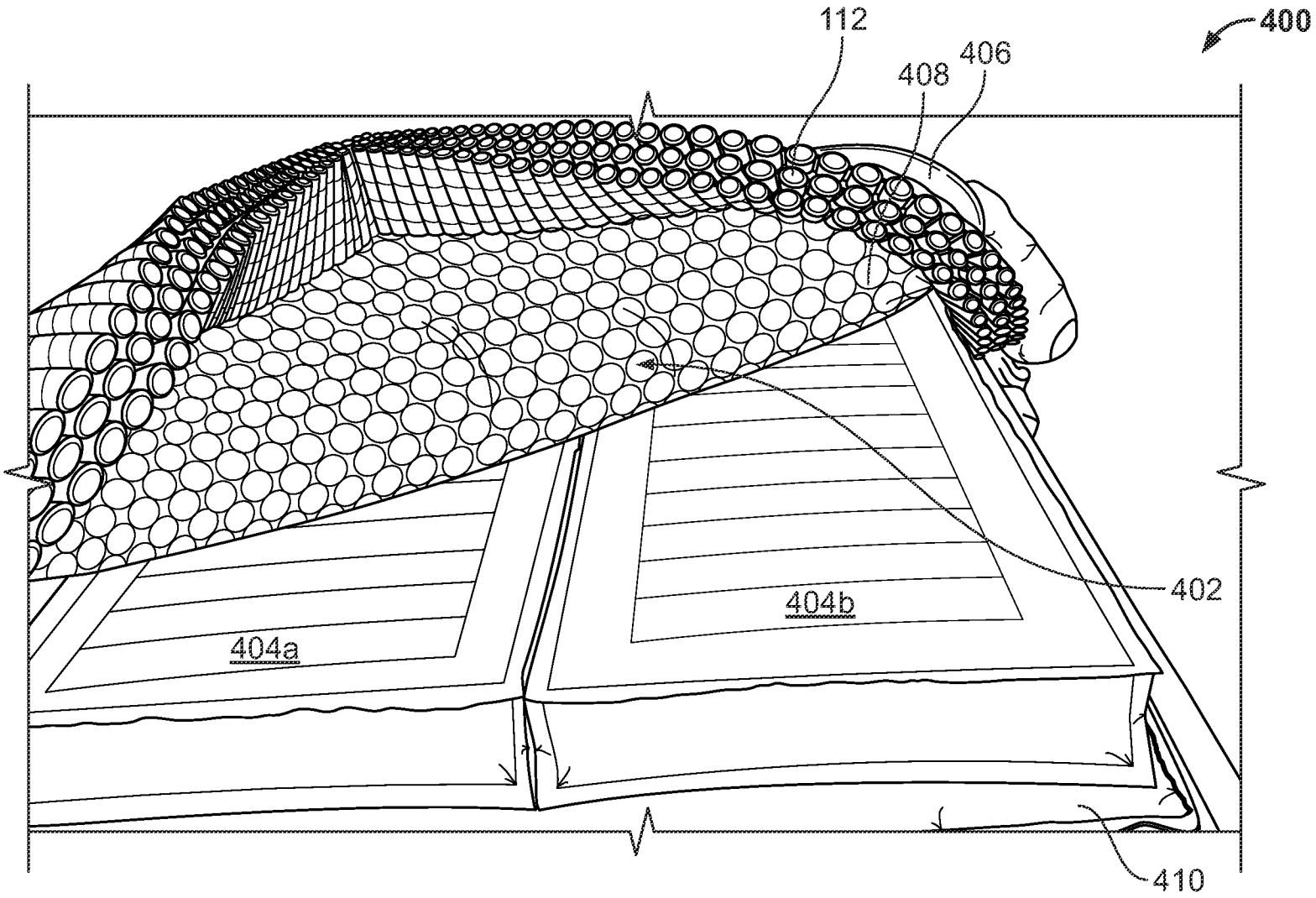
FIG. 4 is a perspective view of an example mattress with a coiled spring perimeter and topper pulled away from a mattress core.

FIG. 4 is a perspective view of an example mattress 400 with a coiled spring perimeter 112 and a topper portion 402 pulled away from a mattress core. The mattress 400 is substantially similar to the mattress 300 previously described with the exception of any differences described herein. The mattress 400 includes a first core 404*a* and a second core 404*b* for supporting a first user and a second user, respectively. For example, the first core 404*a* and the second core 404*b* can include a first air chamber and a second air chamber, respectively. Each of the cores can have a different firmness depending on user preference. In embodiments with inflatable air chambers, the first and second cores 404*a* and 404*b* can each have a variable firmness. Both the first mattress core 404*a* and the second mattress core 404*b* are positioned inside the coiled spring perimeter 112 and under the topper portion 402.

The topper portion 302 in FIG. 3 is shown with first and second layers of foam, while the topper portion 402 in FIG. 4 is shown with a top layer of foam 406 and a bottom layer of coiled springs 408. In other embodiments, the topper portions 302 and 402 can have more, fewer, or different layers as suitable for the application.

In one embodiment, the topper portion 402 can be connected to the coiled spring perimeter 112. For example, the topper portion 402 and the coiled spring perimeter 112 can be combined as a single unit during manufacturing as an inverted tub. The topper portion 402 and the coiled spring perimeter 112 can be stored separately from the first and second cores 404*a* and 404*b* until it is time for assembly of the mattress 400, either at an assembly facility or in a home of the user. At the time of assembly, the inverted tub that includes the topper portion 402 and the coiled spring perimeter 112 can be placed over the first and second cores 404*a* and 404*b* and a cover 410 of the mattress 400 can be closed around the internal components (such as by zipping, buttoning, or otherwise fastening the cover 410 closed, for example).

In some embodiments of the mattress 400 (as well as some embodiments of the other mattress variations described herein), the coiled spring perimeter 112 can be stored in a compressed state during the time between manufacture of the coiled spring perimeter 112 and the assembly of the mattress 400. In other embodiments, the mattress 400 can be stored in a compressed state after assembly. In some of the various embodiments, the springs of the coiled spring perimeter can be configured to be compressed for an extended period of time and spring back to shape after becoming uncompressed. Accordingly, the coiled spring perimeter can be configured to resist permanent deformation during compression for extended periods. By using the coiled spring perimeter 112 in combination with the topper portion 404 (having one or more layers of foam and/or coiled springs) and one or more cores 404*a* and 404*b*, the mattress 400 can be manufactured with materials that are high quality and high performance for the specific functions those materials are needed to perform within the mattress 400 while using lower quality components in other areas. For example, a high quality foam material can be used for the top layer of foam 406 without having to use lower quality foam material for the perimeter of the mattress 400 around the cores 404*a* and 404*b*.

Figure 5:
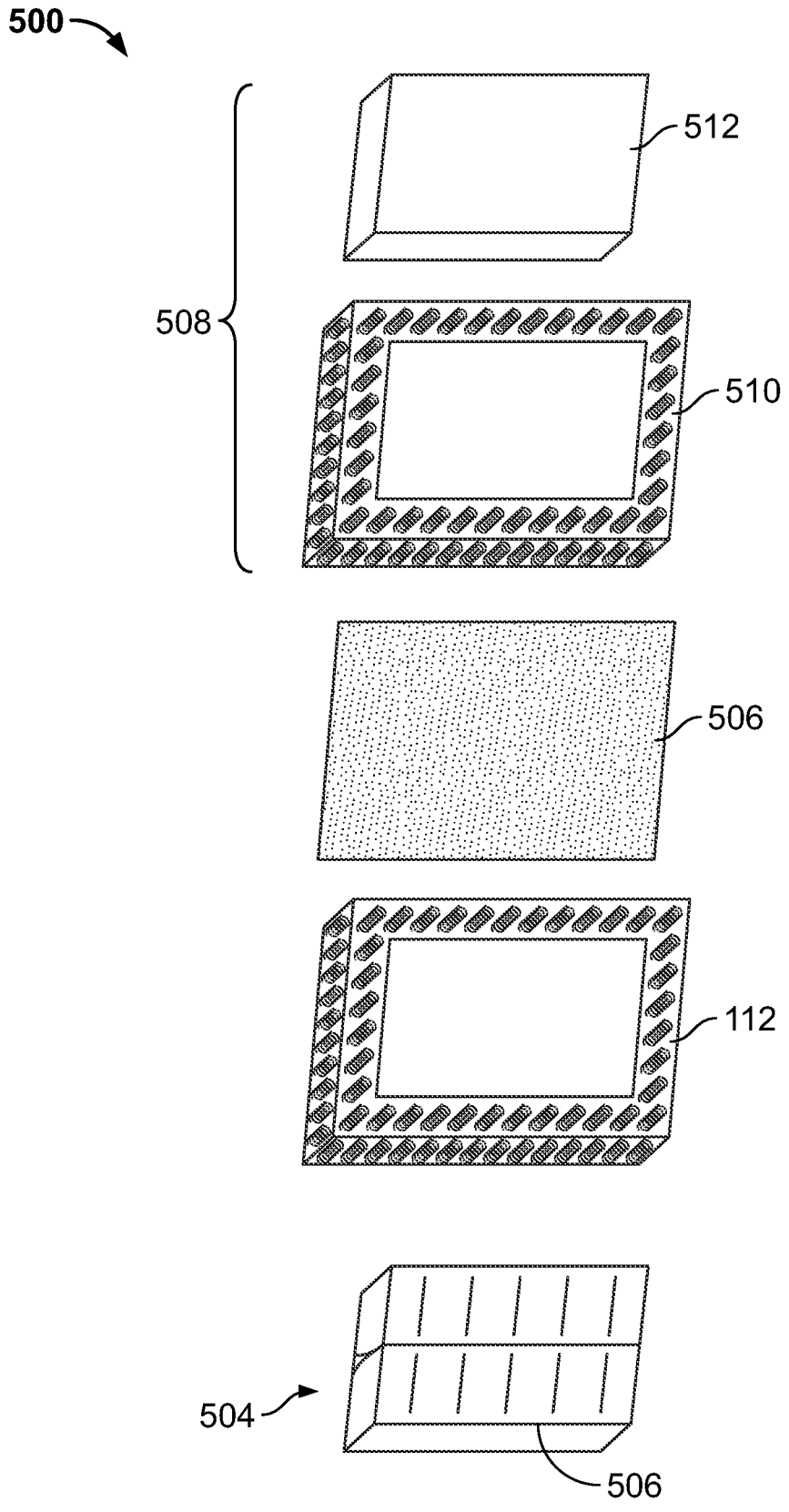
FIG. 5 is an exploded view of an example mattress that can be used with aspects of this disclosure.

FIG. 5 is an exploded view of an example mattress that can be used with aspects of this disclosure. The mattress 500 is substantially similar to the mattress 400 previously described with the exception of any differences described herein. The mattress 500 includes two air chambers 504 as mattress cores. The perimeter of the air chambers 504 is surrounded by the spring perimeter 112. The upper surface of the air chambers 504 and the upper surface of spring perimeter 112 are substantially in-line with one another within standard manufacturing tolerances. Atop the air chambers 504 and the spring perimeter 112 is a layer of scrim fabric 506. The scrim fabric 506 is positioned between the topper portion 508 and the upper surfaces of the air chambers 504 and spring perimeter 112. The scrim fabric 506 can be attached to the spring perimeter 112, the topper portion 508, the air chambers 504, or any combination thereof.

Figure 6:
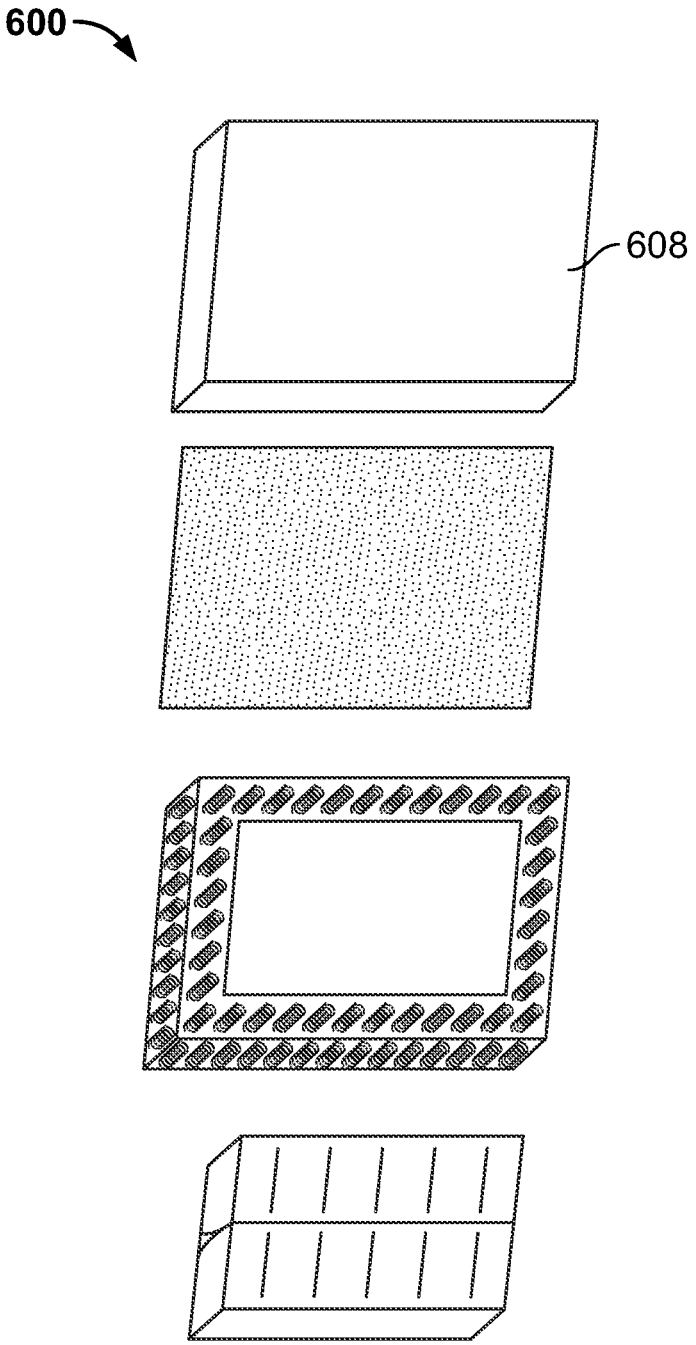
FIG. 6 is an exploded view of an example mattress that can be used with aspects of this disclosure.

Atop the coil spring perimeter 112 is the topper portion 508. As illustrated, the topper portion 508 includes a second set of perimeter springs 510 and a foam topper portion core 512. The second set of perimeter springs 510 rests above and has similar top-down dimensions as the main spring perimeter 112. The second set of perimeter springs 510 can have a different vertical height as well as a different spring rate as the coiled spring perimeter 112. In such an embodiment, the main spring perimeter 112 is attached to an underside of the scrim fabric, for example, with an adhesive. The second set of perimeter springs 510 and the foam topper portion core 512 can similarly be attacked to an upper side of the scrim fabric, for example, with adhesive FIG. 6 is an exploded view of an example mattress that can be used with aspects of this disclosure. The mattress 600 is substantially similar to the mattress 500 previously described with the exception of any differences described herein. As illustrated in this embodiment, the topper portion 608 may include only foam. One or more layers of foam can be used in topper portion 608.

Figure 7:
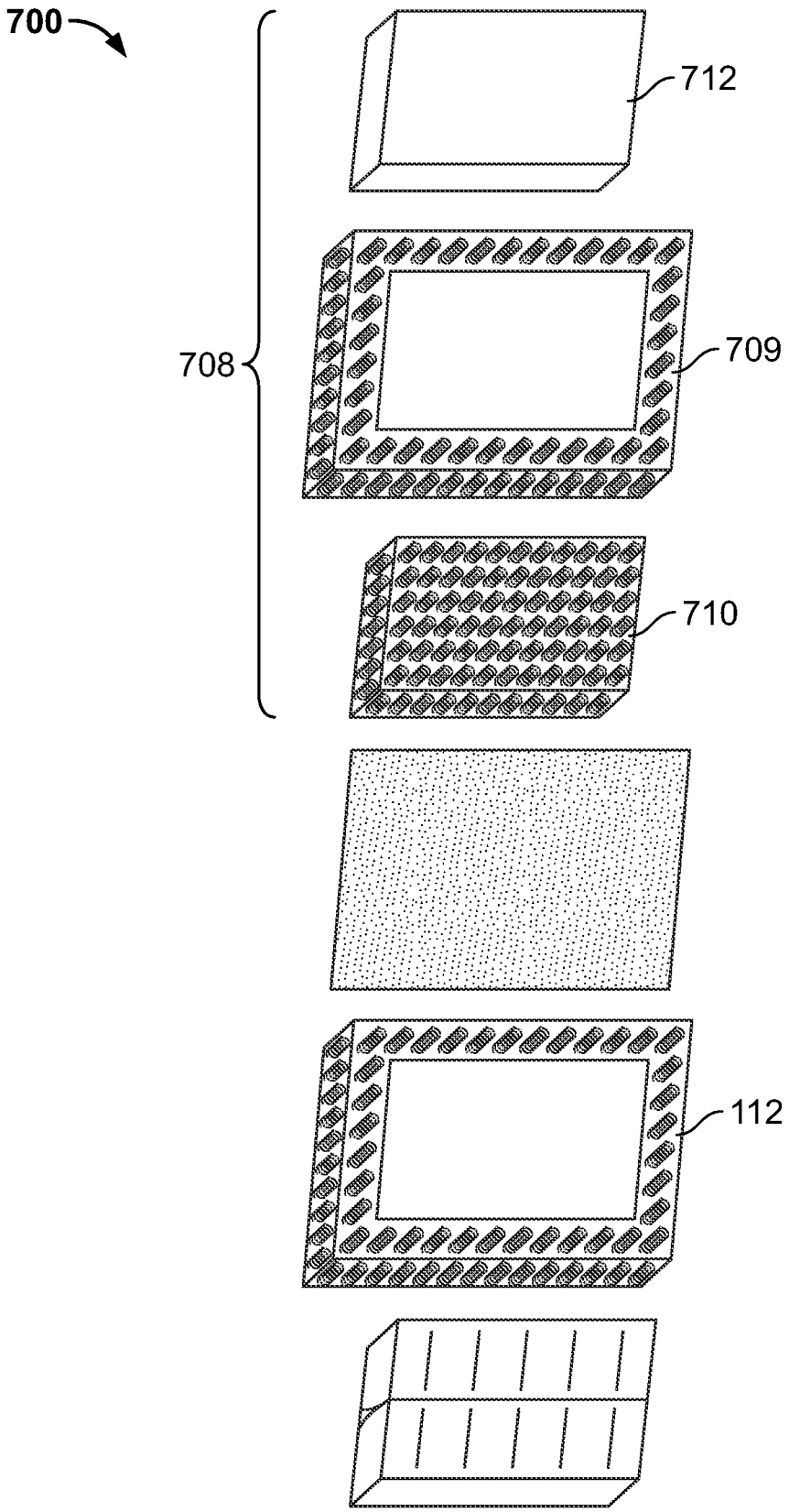
FIG. 7 is an exploded view of an example mattress that can be used with aspects of this disclosure.

FIG. 7 is an exploded view of an example mattress that can be used with aspects of this disclosure. The mattress 700 is substantially similar to the mattress 500 previously described with the exception of any differences described herein. As illustrated, the topper portion 708 includes a topper portion perimeter 709 that includes a second set of coiled springs. In addition, the topper portion 708 includes a support layer made up of a spring layer 710 and a foam layer 712. The spring layer 510 is recessed within the spring perimeter 112 and attached via the underside of the scrim fabric. This allows for a clean edge and transition to the foam 712 while still maintain the spring support. The spring layer 710 can have different spring parameters (e.g. spring rates and/or geometries) than either the springs in the spring perimeter 112 or the springs in the topper portion perimeter 709. In addition to the spring layer 710 within the support layer 708, the support layer 708 can also include one or more layers of foam 712. The foam 712 can be positioned at a top of the mattress 700, covering tops of both the topper portion perimeter 709 and the spring layer 710.

In some embodiments the foam 712 can be positioned above the spring layer 710. In other embodiments, the foam layer 712 can be positioned underneath the spring layer 710. In some embodiment, each group of springs (the spring perimeter 112, the topper portion perimeter springs 709, and the spring layer 710) can all have a different spring parameters (e.g. spring rates and/or geometries).

Figure 8:
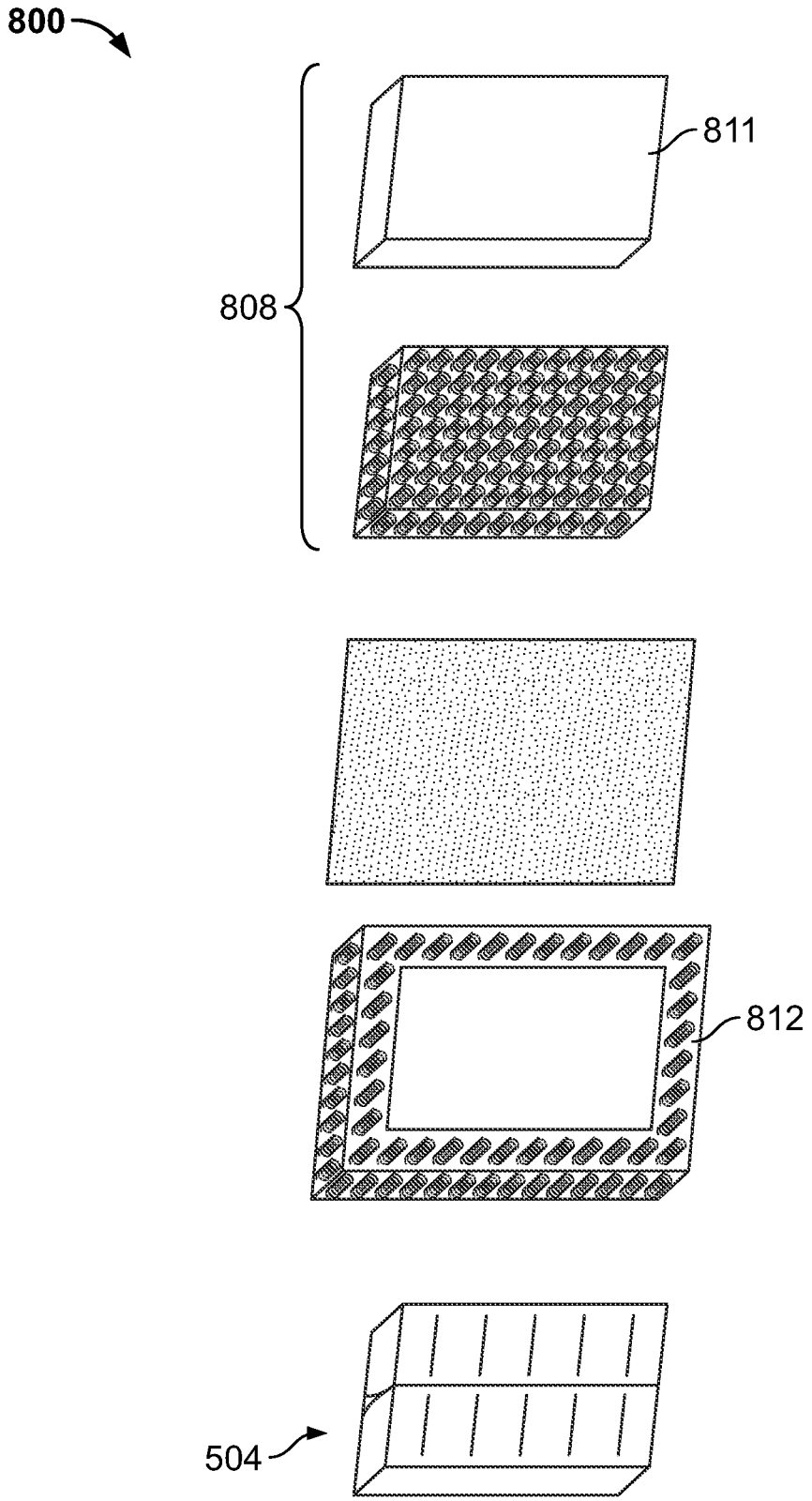
FIG. 8 is an exploded view of an example mattress that can be used with aspects of this disclosure.

FIG. 8 is an exploded view of an example mattress 800 that can be used with aspects of this disclosure. The mattress 800 is substantially similar to the mattress 400 previously described with the exception of any differences described herein. The coil spring perimeter 812 surrounds the perimeter of the air chambers 504. Similar to the geometry shown and described with respect to FIG. 4, the spring layer 810 is positioned above and covers both the air chambers 504 an the coil spring perimeter 812. The foam layer 811 is positioned above and covers the spring layer 810.

Figure 9:
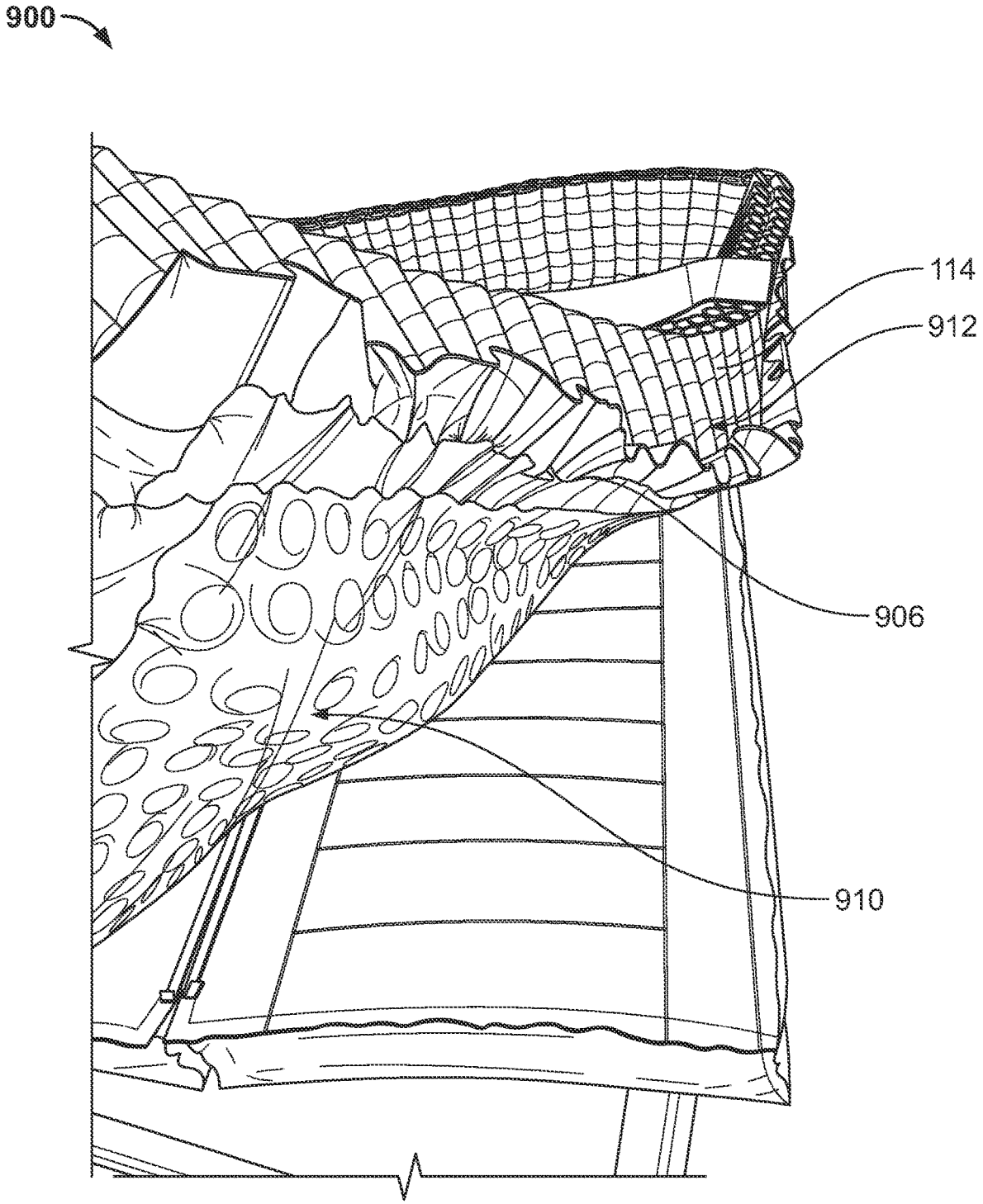
FIG. 9 a perspective view of an example upside-down or inverted tub 900 that can be used with aspects of this disclosure.

FIG. 9 is a perspective view of an example upside-down or inverted tub 900 that can be used with aspects of this disclosure. The inverted tub 900 is similar to the previously described arrangements with the exception of any differences expressed herein. In this view the inverted tub 900 is displayed upside-down, and includes a coiled spring perimeter 912 and a spring layer 910. Both the coiled spring perimeter 912 and a spring layer 910 are attached to an underside of a scrim 906. In the illustrated embodiment, the coiled spring perimeter 912 includes two columns of springs 114

During manufacturing of the embodiments described herein, a mattress with a mattress top, a mattress bottom, and a mattress perimeter is formed. The finished mattress includes a core, such as an air chamber having an air chamber perimeter. A coiled spring perimeter of coiled springs surrounds the air chamber perimeter. A topper portion with a support layer is positioned between the air chamber and the mattress top. In some embodiments, the topper portion is received by a chamber defined by the coiled spring perimeter and the air chamber. In some embodiments, the topper portion has a geometry such that an upper surface of the topper portion is substantially in line with an upper surface of the coiled spring perimeter within standard manufacturing tolerances. During manufacture, a scrim is received under the topper portion. After the mattress is completed, the mattress is received by a foundation or other base that supports the mattress.

While this specification contains many specific embodiment details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. For example, while individual layers of certain embodiments may have been illustrated or described in a certain order, other arrangements can be used without departing from this disclosure. In some embodiments, the supporting spring layer can be separated into zones by changing the spring constant (i.e., firmness) of the coils throughout different areas of the layer. Also, forced air flow through ducting/zoning/wrapping of sections can be added without departing from this disclosure. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

compressing a coiled spring perimeter to a compressed state, the coiled spring perimeter comprising a first plurality of coiled springs configured to surround an air chamber of a mattress;

storing the coiled spring perimeter in the compressed state prior to forming the mattress with the coiled spring perimeter; and forming the mattress, the mattress defining a mattress top, a mattress bottom, and a mattress perimeter including the coiled spring perimeter, wherein the mattress comprises:

the air chamber having an air chamber perimeter;

the coiled spring perimeter comprising the first plurality of coiled springs surrounding the air chamber perimeter; and a topper portion with a topper layer between the air chamber and the mattress top.

2. The method of claim 1, wherein forming the mattress comprises positioning the topper portion inside an interior space defined by the coiled spring perimeter, the topper portion having a geometry such that an upper surface of the topper portion is substantially in line with an upper surface of the coiled spring perimeter.

3. The method of claim 1, wherein forming the mattress further comprises receiving a scrim between the topper portion and the air chamber.

4. The method of claim 1, further comprising:

receiving the mattress by an adjustable foundation; and retaining the mattress to adjustable foundation platforms of the adjustable foundation so as to retain the air chamber, the coiled spring perimeter, and the topper portion on the adjustable foundation.

5. The method of claim 1, and further comprising:

compressing the mattress to a compressed state that compresses the coiled spring perimeter and storing the mattress in the compressed state after forming the mattress.

6. The method of claim 1, wherein:

the air chamber comprises a first structure; and the coiled spring perimeter and the topper portion comprise a second structure, the topper layer connected to the coiled spring perimeter such that the second structure forms a cavity defined therein, the cavity sized to receive the first structure such that the topper portion is above the first structure and the coiled spring perimeter surrounds the air chamber when the first structure is positioned inside the second structure.

7. The method of claim 6, wherein the second structure defines the cavity, such that the cavity forms an upside-down cavity that covers the air chamber.

8. The method of claim 1, wherein the topper portion comprises a layer of foam and a second plurality of coiled springs.

9. The method of claim 8, wherein the topper layer comprises at least a first portion of the second plurality of coiled springs.

10. The method of claim 9, wherein the first plurality of coiled springs has a different spring rate than the second plurality of coiled springs.

11. The method of claim 8, wherein the mattress further comprises a scrim between the layer of foam and the second plurality of coiled springs.

12. The method of claim 8, wherein the topper portion comprises a topper portion perimeter comprising at least a second portion of the second plurality of coiled springs.

13. The method of claim 1, wherein the topper portion is inset such that an upper surface of the topper portion is substantially in line with an upper surface of the coiled spring perimeter.

14. The method of claim 1, wherein the coiled spring perimeter comprises a pocketed coil system, wherein coiled springs of the first plurality of coiled springs are individually pocketed.

15. The method of claim 1, wherein a top of the coiled spring perimeter is connected to a bottom of the topper portion.

16. The method of claim 1, wherein a mattress cover encloses the topper portion, the coiled spring perimeter, and the air chamber.

17. The method of claim 1, wherein the air chamber comprises a first air chamber positioned in the mattress for supporting a first user, wherein the mattress further comprises a second air chamber positioned in the mattress for supporting a second user, and wherein both of the first and second air chambers are positioned inside the coiled spring perimeter.

18. The method of claim 1, further comprising: providing a means to support the mattress.

* * * * *